US005757138A

United States Patent [19]

Tsai

[11] Patent Number: 5,757,138

[45] Date of Patent: May 26, 1998

[54] LINEAR RESPONSE FIELD EMISSION DEVICE

[75] Inventor: Chun-hui Tsai, Hsinchu, Taiwan

[73] Assignee: Industrial Technology Research Institute, Hsin-Chu, Taiwan

[21] Appl. No.: 641,668

[22] Filed: May 1, 1996

[51] Int. Cl.[6] ..... G09G 3/10

[52] U.S. Cl. ..... 315/169.3; 315/167; 315/58; 313/309; 313/336

[58] Field of Search ..... 315/58, 169.1, 315/169.3, 167, 350; 313/309, 336, 351

[56] References Cited

U.S. PATENT DOCUMENTS

| | | | |
|---|---|---|---|
| 3,789,471 | 2/1974 | Spindt et al. | 29/25.17 |
| 5,012,153 | 4/1991 | Atkinson et al. | 313/336 |
| 5,070,282 | 12/1991 | Epsztein | 315/383 |
| 5,162,704 | 11/1992 | Kobori et al. | 315/349 |
| 5,191,217 | 3/1993 | Rane et al. | 250/423 |
| 5,585,301 | 12/1996 | Lee et al. | 315/169.1 X |
| 5,589,738 | 12/1996 | Onodaka et al. | 315/169.1 |

*Primary Examiner*—Robert Pascal
*Assistant Examiner*—Haissa Philogene
*Attorney, Agent, or Firm*—George O. Saile; Stephen B. Ackerman

[57] ABSTRACT

A design for a field emission device comprising a cold cathode emitter, a control gate and a focus gate, is discussed. The focus gate is connected to the emitter voltage source and a ballast resistor is inserted between this connection point and the emitter. This ensures that the focus gate will always be more negative than the emitter, this difference in potential increasing with increasing emitter current. This leads to a linear current-voltage characteristic for the device and also makes for a tighter electron beam than that provided by designs of the prior art. A physical realization of the design is described along with a cost effective method for manufacturing said physical realization.

13 Claims, 4 Drawing Sheets

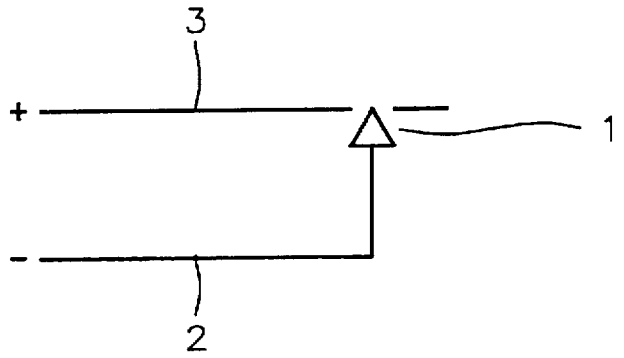
FIG. 1 – Prior Art
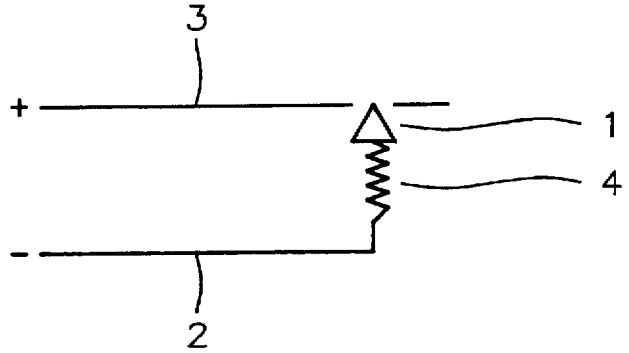
FIG. 2 – Prior Art
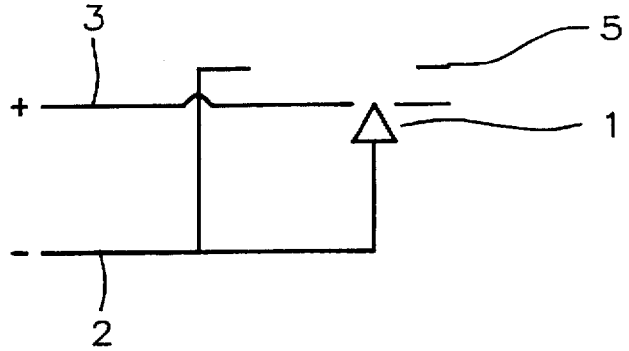
FIG. 3a – Prior Art
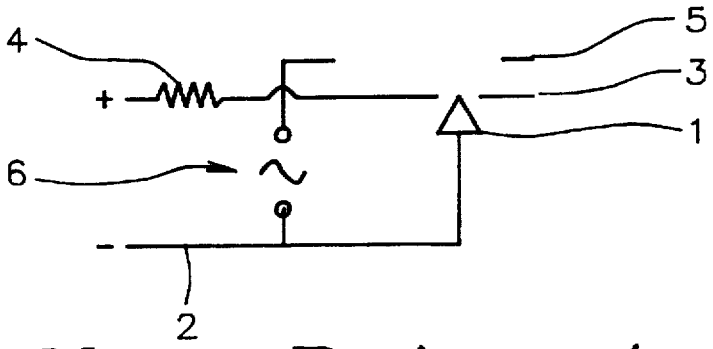
FIG. 3b – Prior Art

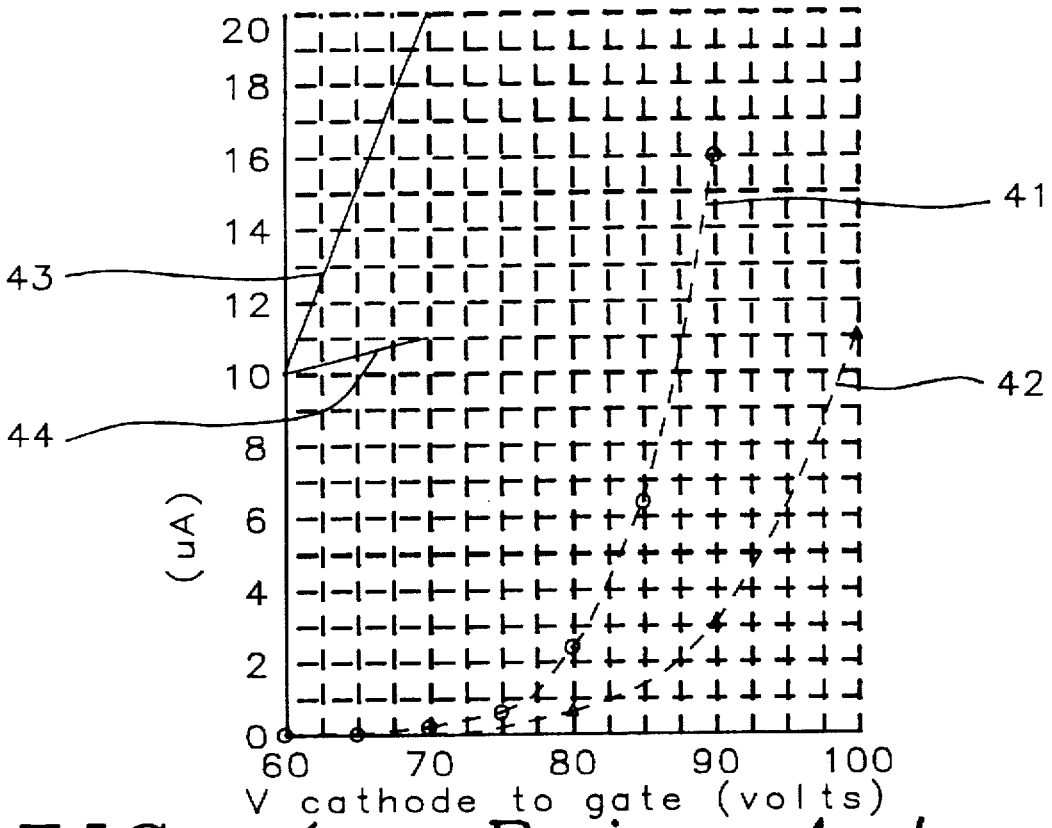
FIG. 4 – Prior Art
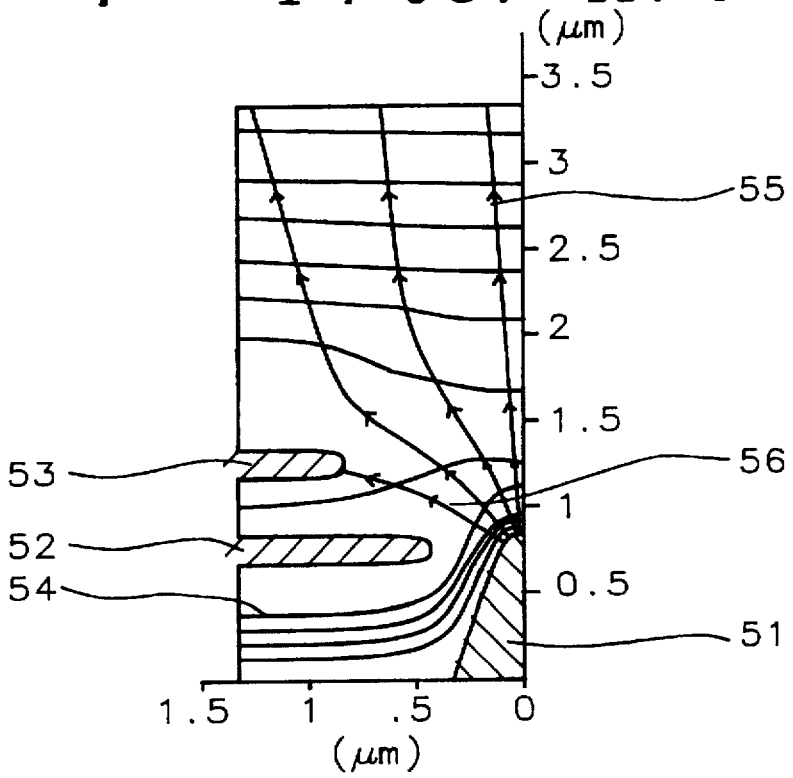
FIG. 5 – Prior Art

LINEAR RESPONSE FIELD EMISSION DEVICE

BACKGROUND OF THE INVENTION

1. Field of the Invention

The invention relates to cold cathode (high field) electron emission devices particularly to their design and control.

2. Description of the Prior Art

Cold cathode electron emission devices are based on the phenomenon of high field emission wherein electrons can be emitted into a vacuum from a room temperature source if the local electric field at the surface in question is high enough. The creation of such high local electric fields does not necessarily require the application of very high voltage, provided the emitting surface has a sufficiently small radius of curvature.

The advent of semiconductor integrated circuit technology made possible the development and mass production of arrays of cold cathode emitters of this type. In most cases, cold cathode field emission displays comprise an array of very small emitters, usually of conical shape, each of which is connected to a source of negative voltage via a cathode line. Another set of conductive lines (called control gate lines) is located a short distance above the cathode lines at an angle (usually 90°) to them, intersecting with them at the locations of the conical emitters, or microtips, and connected to a source of voltage that is positive relative to the cathode line. Both the cathode and the control gate line that relate to a particular microtip must be activated before there will be sufficient voltage to cause cold cathode emission.

The electrons that are emitted by the cold cathodes accelerate past openings in the gate lines and strike an electroluminescent panel that is located some distance above the gate lines. Thus, one or more microtips serves as a sub-pixel for the total display. The number of sub-pixels that will be combined to constitute a single pixel depends on the resolution of the display and on the operating current that is to be used.

FIG. 1 is a schematic diagram of the above-described setup. High field emission source 1 is electrically connected to cathode line 2. Control gate line 3, running orthogonal to cathode line 2, is positioned above line 2, at the height of the tip, or apex, of emitter 1. An opening in line 3 is positioned so that emitter 1 is centrally located beneath it.

In general, even though the local electric field in the immediate vicinity of a microtip is in excess of 1 million volts/cm., the externally applied voltage is under a 100 volts. However, even a relatively low voltage of this order can obviously lead to catastrophic consequences, if short circuited. Consequently, a resistor needs to be placed between either the cathode lines or the control gate lines and the power supply, as ballast to limit the current in the event of a short circuit occurring somewhere within the display.

This is schematically illustrated in FIG. 2. Ballast resistor 4 has been inserted between cathode line 2 and emitter 1. In the early art, such ballast resistors were separate from and external to the individual emitters but in recent years a number of schemes have been proposed to make it possible to supply each emitter with its own separate ballast resistor. The technology of such schemes is not yet mature but steady progress is being made.

Not shown in either FIG. 1 or 2 is an anode surface located above (downstream from) the control gate line. Such an anode surface would collect the electrons emanating from the emitters. It would also be coated with a suitable phosphor so as to light up whenever it was under electron bombardment. One problem with arrangements such as those illustrated in FIGS. 1 and 2 is that the electron beam that originates at the emitter tends to spread out, because of mutual repulsion, on its way to the anode, arriving there as a relatively diffuse spot. Additionally, the current-voltage (I-V) curve tends to be non-linear, current increasing more rapidly than voltage.

A partial solution to these problems has been described by, for example, Kane et al. (U.S. Pat. No. 5,191,217 March 1993). Kane's scheme is shown schematically in FIG. 3*a*. Focus grid 5 has been added to the basic circuit of FIG. 1. It is connected directly to cathode line 2 and is therefore always at the same electrical potential as 2. As a consequence, as the beam passes focus grid 5 it is forced to shrink to some extent, resulting in a sharper spot at the anode. Additionally some of the electrons that comprise the outermost portions of the beam are collected by the focus grid, reducing, to some extent, the excess of current arriving at the anode.

A similar approach to that of Kane et al. has been described by Epsztein (U.S. Pat. No. 5,070,282 December 1991). This is schematically illustrated in FIG. 3*b*. The principal differences over Kane are that the ballast resistor 4 has been inserted between the control gate and the power supply and that the modulating signal 6 is applied between the cathode line 2 and the focus grid 5. In the other schemes the modulating signal was applied between the cathode line and the control gate line.

The effectiveness of these schemes is illustrated in FIGS. 4 and 5. FIG. 4 is a simulation-based plot of current vs. voltage, curve 41 being for a basic setup, such as that of FIG. 1, while curve 42 is for the modified setup described by Kane and Epsztein (as illustrated in FIGS. 3*a* and 3*b* respectively). Curves 43 and 44 are for resistors having values of 1 megohm and 10 megohms respectively, and have been included for comparison purposes. It can be seen that for both of these curves the resistance of the devices varied from about 10 megohms, at low voltages, to about 1 megohm at higher voltages, although the variation in resistance with voltage was clearly less for the modified setups.

FIG. 5 is a cross-section of the left half of an electron source such as those shown in FIGS. 3*a* or 3*b*. Conical emitter 51 is centrally located with respect to control gate 52 and focus grid 53. Regular lines in the figure, such as 54, represent equipotential surfaces while arrowed lines such as 55 represent electron trajectories. As can be seen, the beam is still diverging as it approaches the anode (not shown, but located at about 200 microns on the vertical scale of FIG. 5). Also seen, is an example of an electron (trajectory 56) striking focus gate 53 rather than going to the anode.

SUMMARY OF THE INVENTION

An object of the present invention has been to design a field emission device whose current-voltage curve is essentially linear.

Another object of the present invention has been to design a field emission device that provides a narrow electron beam.

Yet another object of the present invention has been to show how the two preceding objects may be physically realized.

A further object of the present invention has been to provide a method for the cost effective manufacture of said physical realization.

These objects have been achieved by designing a field emission device comprising a cold cathode emitter, a control gate and a focus gate. The latter is connected to the emitter voltage source and the ballast resistor is inserted between this connection point and the emitter. This ensures that the focus gate will always be more negative than the emitter, this difference in potential increasing with increasing emitter current. This leads to a linear current-voltage characteristic for the device and also makes for a tighter electron beam than that provided by designs of the prior art. A physical realization of the design is described along with a cost effective method for manufacturing said physical realization.

BRIEF DESCRIPTION OF THE DRAWINGS

FIG. 1 is a schematic diagram of the basic circuit for a high field electron emission device.

FIG. 2 shows how the schematic of FIG. 1 may be modified to include a ballast resistor.

FIG. 3*a* is a modification of FIG. 1 to include a focus gate.

FIG. 3*b* is as FIG. 3*a* with the addition of a ballast resistor at the control gate.

FIG. 4 shows current-voltage curves for designs corresponding to FIGS. 1 and 3 respectively.

FIG. 5 plots electron trajectories and equipotential surfaces for a device corresponding to FIGS. 3.

DESCRIPTION OF THE PREFERRED EMBODIMENTS

Figure 6:
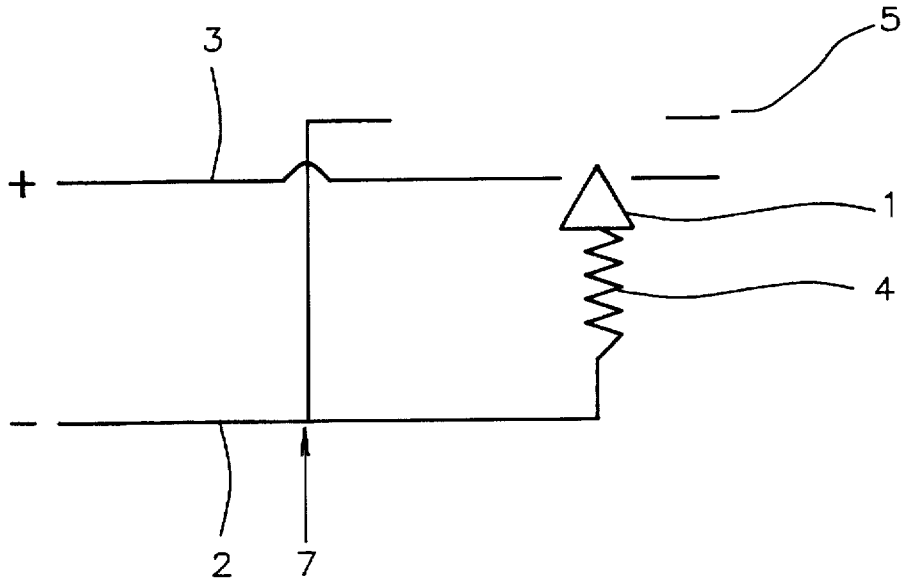
FIG. 6 is a schematic diagram of the basic circuit for a high field electron emission device based on the present invention.

FIG. 6 schematically illustrates the scheme taught by the present invention. Emitter 1 is centrally located within the opening in control gate 3 so that its apex is level with gate 3. Ballast resistor 4 is located between cathode line 2 and emitter 1, closer to the latter than connection point 7 where control grid 5 is connected to cathode line 2. This arrangement ensures that emitter 1 will always be at a higher (less negative) potential than focus grid 5 which is maintained at the reference potential (often ground, but also possibly a video data signal) of cathode line 2. This has two consequences. First, the focussing effect of grid 5 will be stronger (relative to the previously described prior art setups). Second, the difference in potential between 1 and 5 will increase as current increases, making for a more linear I–V characteristic.

Figure 7:
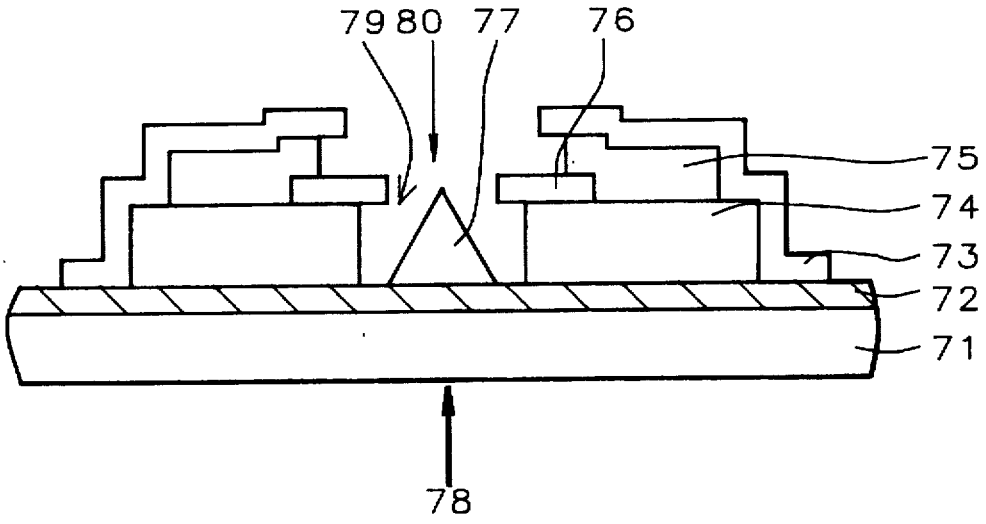
FIG. 7 illustrates a physical realization of the schematic of FIG. 6.

FIG. 7 illustrates, in schematic cross-section, a physical embodiment of the diagram shown in FIG. 6. Resistive layer 72, comprising amorphous silicon, was deposited onto the upper surface of substrate 1 to a thickness between about 1,000 and 4,000 Angstroms and a sheet resistance between about $10^6$ and $10^8$ ohms per square. Following deposition, said layer was covered with photoresist, exposed through the appropriate mask and then developed (i.e. patterned) and then etched to form ballast resistors. Conductive layer 73, of niobium or molybdenum, is deposited and patterned to form cathode lines (lying in the plane of the figure) that connect to resistive layer 72.

This was followed by the deposition of insulating layer 74 of silicon oxide or silicon nitride, to a thickness between about 5,000 and 15,000 Angstroms. Layer 74 was then patterned and etched to form lines slightly smaller than, and lying within, the previously formed cathode lines that comprise resistive material.

Conductive layer 76, comprising niobium or molybdenum, was then deposited onto the structure, following which it was patterned and etched to form control gate lines running orthogonally relative to said cathode lines (i.e. perpendicular to the plane of the figure). Then openings 79 were formed in layer 76 at the intersections of the control gate lines and the ballast resistor. This was followed by the deposition of second insulating layer 75, comprising silicon oxide or silicon nitride to a thickness between about 2,000 and 10,000 Angstroms.

Next, conductive layer 77, also comprising niobium or molybdenum, was deposited and then patterned and etched to form openings 80 (which are larger than 79) and to exactly overlie the resistive cathode lines as well as to connect to conductive layer 73. Openings 80 were then used as masks to etch layer 75. Similarly, opening 79 was used as a mask to etch layer 74.

Once openings 79 had been formed, emitters 77 were formed. Said emitters were centrally located within the openings 79 and rested on resistive layer 72. Their high points (apexes) were arranged to be at the same height as layer 76. As part of the emitter formation process, the openings in layer 76 closed up again. While they were in this condition, the sizes of the openings in layers 75 and 76 were increased, together with a small amount of overetching of layer 75. Finally, the opening in layer 76 was re-formed but kept slightly smaller than the opening in layer 74.

The appearance of the structure after the completion of the above process is shown in FIG. 7. As can be seen, the conductive part of the cathode line, comprising layer 73, is connected to emitter 77 through resistive layer 72. Typically the value of the resistor formed in this manner was between about $10^6$ and $10^8$ ohms. Not shown in FIG. 7 is the light emitting surface which is conductive, phosphor-bearing, surface located above layer 73.

Figure 8:
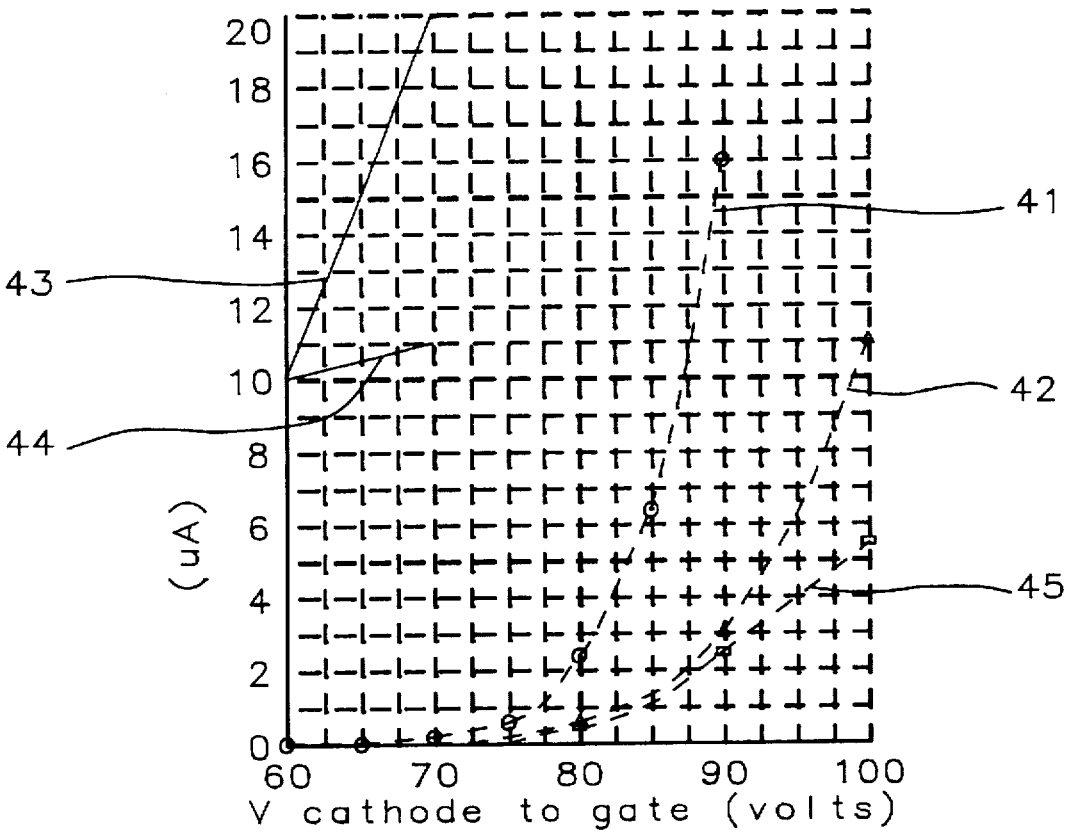
FIGS. 8 and 9 correspond to FIGS. 4 and 5 respectively, for the present invention.
Figure 9:
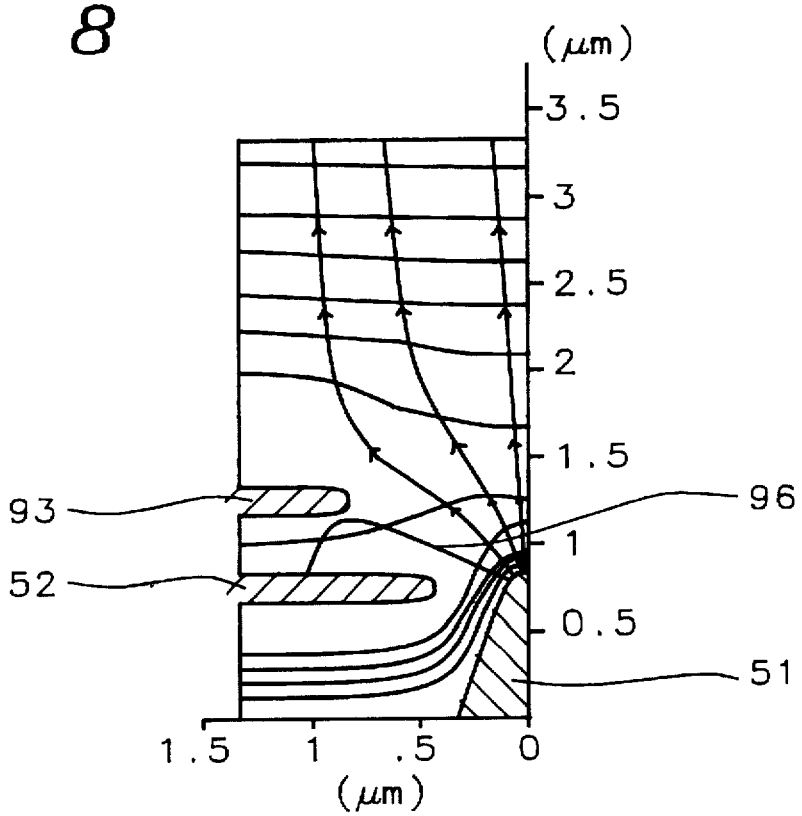

The improvements over the prior art that the present invention provides can be seen by referring to FIGS. 8 and 9. FIG. 8 refeatures the curves shown in FIG. 4 and adds curve 45 which is the curve for a high field electron emission device based on the teachings of the present invention. As can be seen, the I-V response of such a device, for currents in excess of about 0.5 microamps, is very close to linear, corresponding to a resistor of about 4 megohms.

FIG. 9 is for a device of the present invention and corresponds to FIG. 5 which is for a device of the prior art. Note that, near the top of the figure (as the anode is approached), the beam is almost parallel, as opposed to FIG. 5 where it is still diverging. Note, too, trajectory 96 which shows an electron being repelled by focus gate 93 (corresponding to 5 in FIG. 6) to a sufficient degree as to cause it to return to control gate 52.

While the invention has been particularly shown and described with reference to the preferred embodiments thereof, it will be understood by those skilled in the art that various changes in form and details may be made without departing from the spirit and scope of the invention. To keep this effect to a minimum, the opening in 52 (corresponding to opening 79 in FIG. 7) is made greater than or equal to the opening in 93 (which corresponds to opening 80 in FIG. 7).

What is claimed is:

1. A high field electron emission structure comprising:

a substrate having an upper surface;

a resistive layer on said upper surface;

a first insulating layer on said resistive layer;

a first opening in said first insulating layer down to the level of said resistive layer;

a source of high field electron emission, having an apex, on said resistive layer, centrally located within said first opening;

a first conductive layer on said first insulating layer;

a second opening, in said first conductive layer, said second opening being centrally located over said source, at the same height as said apex, and having a width that is equal to or less than that of said first opening;

a second insulating layer on said first conductive layer;

a second conductive layer on said second insulating layer, electrically connected to said resistive layer; and a third opening, in said second conductive layer, said third opening being centrally located over said source and having a width that is equal to or greater than that of said first opening.

2. The structure of claim 1 wherein said resistive layer comprises silicon.

3. The structure of claim 1 wherein the thickness of said resistive layer is between about 1,000 and 5,000 Angstroms.

4. The structure of claim 1 wherein said resistive layer has a sheet resistance between about 1 and 100 megohms per square.

5. The structure of claim 1 wherein said high field emission source comprises molybdenum or silicon or niobium.

6. The structure of claim 1 wherein said high field emission source is cone shaped.

7. The structure of claim 1 wherein said first insulating layer comprises silicon oxide or silicon nitride.

8. The structure of claim 1 wherein the thickness of said first insulating layer is between about 0.5 and 2 microns.

9. The structure of claim 1 wherein said second insulating layer comprises silicon oxide or silicon nitride.

10. The structure of claim 1 wherein the thickness of said second insulating layer is between about 0.2 and 2 microns.

11. The structure of claim 1 wherein said conductive layers comprise aluminum or molybdenum or chromium.

12. The structure of claim 1 further comprising:

a conductive, phosphor-bearing, surface above said second conductive layer.

13. A method for manufacturing a high field electron emission source, including an emitter, comprising:

providing a substrate having an upper surface;

on said substrate, depositing a first conductive layer and then patterning and etching it to form cathode lines;

depositing a resistive layer on said upper surface;

patterning and etching said resistive layer to form a resistor connecting a cathode line and an emitter;

depositing a first insulating layer on said resistive layer and said first conductive layer;

patterning and etching said first insulating layer, down to the level of said resistive layer, so that it underlaps said resistive layer;

depositing a second conductive layer on said first insulating layer;

patterning and etching said second conductive layer to form control gate lines running orthogonally to said cathode lines;

depositing a second insulating layer on said second conductive layer;

depositing a third conductive layer on said second insulating layer;

patterning and etching said third conductive layer to form a focus gate connected to said cathode lines;

patterning said second conductive layer and then etching down to the level of said resistive layer to form openings at the intersections of said cathode and said control gate lines; and forming high field electron emitters, each having an apex at the level of said second conductive layer, on said resistive layer, centrally located within the openings, at the same time reducing the inner diameters of said openings in said second conductive layer.

* * * * *